United States Patent [19]

Tuka et al.

[11] Patent Number: 5,001,919

[45] Date of Patent: Mar. 26, 1991

[54] APPARATUS FOR STRIPPING WORKPIECES

[75] Inventors: Anthony J. Tuka, Arvada; David I. Biesemeier, Denver; Brian J. Moreland, Thornton; Nick A. Yerbick, Pine; Leo W. Mayer, Lakewood; Nels P. Sale, Golden; Larry W. Roberts; Roger A. Hahn, both of Arvada, all of Colo.

[73] Assignee: Adolph Coors Company, Golden, Colo.

[21] Appl. No.: 509,471

[22] Filed: Apr. 13, 1990

[51] Int. Cl.[5] ..... B21D 45/06

[52] U.S. Cl. ..... 72/344

[58] Field of Search ..... 72/344, 345, 347, 349, 72/427

[56] References Cited

U.S. PATENT DOCUMENTS

| | | | |
|---|---|---|---|
| 2,345,857 | 4/1944 | Newell | 72/344 |
| 2,369,260 | 2/1945 | Slater | 72/344 |
| 2,528,577 | 11/1950 | Catlin et al. | 72/344 |
| 3,664,171 | 5/1972 | Paramonoff | 72/344 |
| 3,990,289 | 11/1976 | Widman et al. | 72/345 |
| 4,324,124 | 4/1982 | Maeder | 72/345 |
| 4,606,215 | 8/1986 | McMillin | 72/344 |
| 4,843,863 | 7/1989 | Grims et al. | 72/349 |

*Primary Examiner*—Robert L. Spruill

*Attorney, Agent, or Firm*—Klaas & Law

[57] ABSTRACT

Apparatus for stripping a cylindrical workpiece, such as a can body, from a cylindrical supporting device, such as a punch of a can body making machine, using a plurality of resilient fingers which are mounted in a circumferentially spaced relationship to provide a circular opening having a diameter less than the outer diameter of the punch so that on the return stroke of the punch, the resilient fingers will be in contact with the outer surface of the punch and will contact the leading edge of the workpiece to disengage it from the punch.

15 Claims, 3 Drawing Sheets

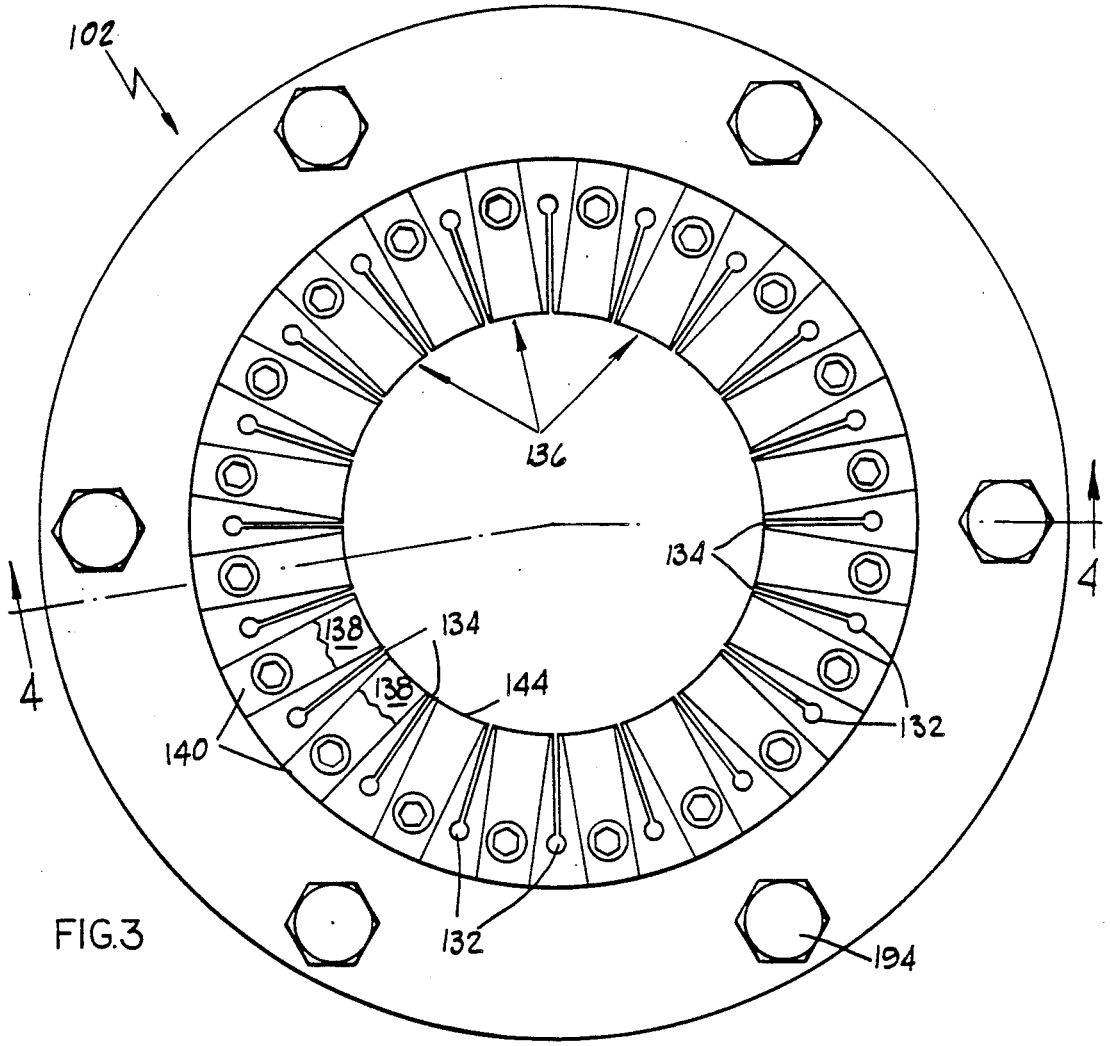
FIG.3
FIG.4
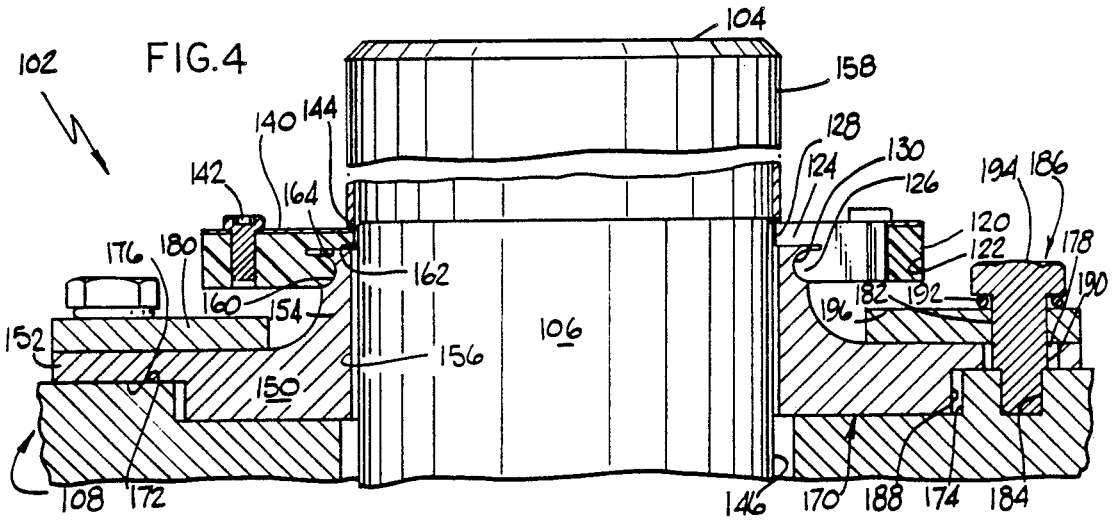

APPARATUS FOR STRIPPING WORKPIECES

FIELD OF THE INVENTION

This invention relates generally to apparatus for stripping a cylindrical workpiece from a cylindrical supporting device and, more particularly, to apparatus for stripping a one-piece can body from the punch of a can body making machine during the return stroke of the punch.

BACKGROUND OF THE INVENTION

Conventional can body making machines employ a removable tool pack assembly and a removable stripper assembly which are removably mounted in a forming cavity of the machine. Conventional stripper assemblies comprise an annular ring support structure mounting a plurality of separate circumferentially spaced apart fingers to form a generally circular opening. The fingers are mounted to provide for individual radially inward or outward movement. In some instances the fingers are resiliently urged against the outer surface of the punch during the return stroke so as to contact the leading edge of the can body to disengage it from the punch. In other instances, the fingers are located to be spaced a very small distance from the outer surface of the punch so that during the return stroke of the punch the fingers contact the leading edge of the can body to disengage it from the punch. While these stripper assemblies remove a can body from the punch, they are formed using a great number of separate members so that there exists a need for a stripping assembly of a much less complicated structure.

BRIEF DESCRIPTION OF THE INVENTION

This invention provides apparatus for stripping a cylindrical workpiece, such as a can body, from a cylindrical supporting device, such as a punch of a can body making machine, on which the cylindrical workpiece is supported using a plurality of resilient fingers which are in contact with the outer surface of the cylindrical supporting device during the return stroke of the cylindrical supporting device so that the resilient fingers will contact the leading edge of the cylindrical workpiece to disengage it from the cylindrical supporting device.

In the normal operation of a can body forming machine, the cylindrical workpiece and a portion of the cylindrical supporting device are moved through stripping apparatus in a forward stroke thereof and during the return stroke the cylindrical workpiece is disengaged from the cylindrical supporting device. In a preferred embodiment of the invention, housing means are used for supporting the stripping apparatus circumjacent to the cylindrical workpiece and the cylindrical supporting device. A plurality of circumferentially spaced apart resilient fingers are mounted on the housing means so as to form a generally circular opening. Each of the resilient fingers has a surface portion facing the cylindrical workpiece and the cylindrical supporting device as they move through the housing means. The generally circular opening formed by the resilient fingers has a diameter which is smaller than the diameter of the outer surface of the cylindrical workpiece and the outer surface of the cylindrical supporting device. Therefore, during the forward stroke, the cylindrical workpiece contacts the resilient fingers and moves them radially outwardly. After the cylindrical workpiece has moved through the resilient fingers, they resile radially inwardly into contact with the outer surface of the cylindrical supporting device. During the return stroke, the resilient fingers remain in contact with the outer surface of the cylindrical supporting device so that the resilient fingers contact the open end surface of the cylindrical workpiece to disengage it from the cylindrical supporting device.

In one embodiment of the invention, each of the resilient fingers comprises a flat, metallic body portion formed from a material such as spring steel and having an integral flange portion extending outwardly therefrom and forming an obtuse angle therewith. The flange portion has oppositely facing surfaces, one of which is the surface portion facing the cylindrical workpiece and the cylindrical supporting device, which surface portion is an arcuate surface which is an arc of a circle having a radius substantially equal to the radius of the outer surface of the cylindrical workpiece and the other of which forms the obtuse angle with the body portion. Mounting means are provided to mount the resilient fingers on the housing means and comprise an annular member having a plurality of circumferentially, equally spaced apart openings formed in an outer peripheral portion thereof. A retainer ring is mounted on the housing means and forms an annular space therebetween. Each body portion is connected to the annular member for movement therewith and the annular member is mounted on the housing means so that a radially outer portion thereof and a portion of the body portion are in the annular space. This mounting provides for limited radial movement of the annular member relative to the housing means in response to radially directed forces applied thereto by the cylindrical workpiece or the cylindrical supporting device. Resilient means are provided to hold the annular member at an adjusted radial location until another radially directed force is applied thereto.

In another embodiment of the invention, the integral fingers comprise an annular, integrally molded plastic member having inner and outer surfaces. A radially outer portion of the plastic member has a plurality of axially extending, circumferentially equally spaced apart openings formed therein. A plurality of radially extending slots are also formed therein and extend from the inner surface to the axially extending openings so as to form the resilient fingers. Each of the resilient fingers has a radially extending recess formed therein, which recess extends through the radially outer portion, and a flat, metallic resilient strip, formed from a material such as spring steel, is mounted in the recess for movement with the resilient finger. Each resilient finger and each resilient strip has an arcuate inner surface which is an arc of a circle having a radius which is slightly smaller than the radius of the outer surface of the cylindrical supporting device so as to have an interference fit therewith. The plastic member is mounted on the housing means so as to permit limited radial movement of the plastic member in response to radially directed forces applied thereto by the cylindrical workpiece or the cylindrical supporting device. Resilient means are provided to hold the plastic member at an adjusted radial location until another radially directed force is applied thereto.

In another preferred embodiment of the invention, the resilient fingers comprise an annular ring having a plurality of radially inwardly extending integral fingers which are circumferentially equally spaced apart by a radially extending slot between adjacent fingers. The annular ring is formed from a resilient metallic material, such as spring steel. An annular plastic member is molded around the annular ring so that the annular ring is embedded therein. The annular plastic member is molded to have a plurality of radially inwardly extending integral fingers which are circumferentially equally spaced apart by a radially extending slot between adjacent fingers. The metallic fingers are in contact with the plastic fingers and each metallic finger has an arcuate extent that is less than the arcuate extent of a plastic finger. Each metallic finger and each plastic finger has an arcuate inner surface which is an arc of a circle having a radius which is slightly smaller than the radius of the outer surface of the cylindrical supporting device so as to have an interference fit therewith. The plastic member is mounted on the housing means so as to permit limited radial movement of the plastic member in response to radially directed forces applied thereto by the cylindrical workpiece or the cylindrical supporting device. Resilient means are provided to hold the plastic member at an adjusted radial location until another radially directed force is applied thereto.

BRIEF DESCRIPTION OF THE DRAWINGS

An illustrative and presently preferred embodiment of the invention is shown in the accompanying drawings in which:

FIG. 3 is a plan view of another embodiment of the stripper apparatus of this invention;

FIG. 4 is a cross-sectional view taken on the line 4—4 of FIG. 3 and illustrating the return stroke of the cylindrical workpiece and the cylindrical supporting device;

DETAILED DESCRIPTION OF THE INVENTION

Figure 1:
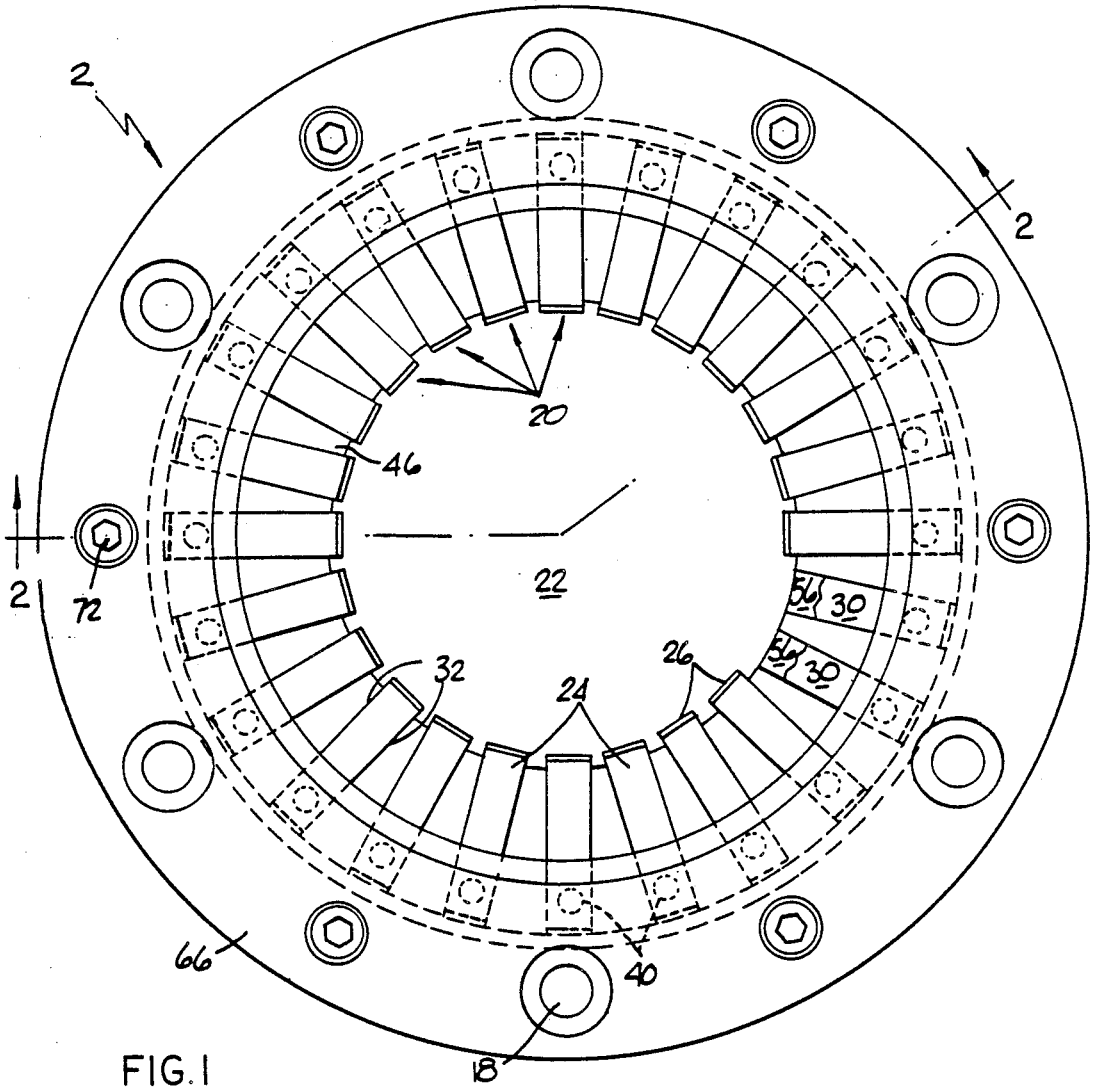
FIG. 1 is a plan view of one embodiment of the stripper apparatus of this invention.
Figure 2:
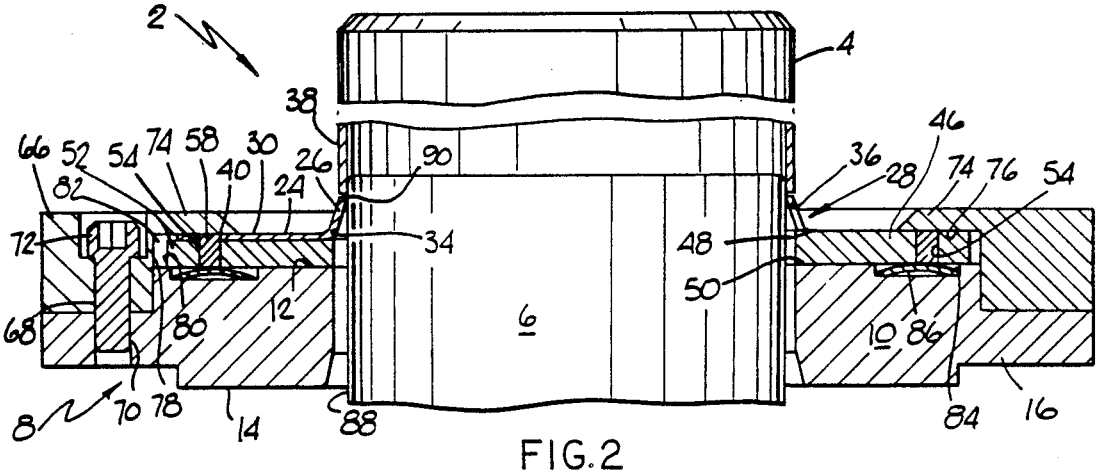
FIG. 2 is a cross-sectional view taken on the line 2—2 of FIG. 1 and illustrating the return stroke of the cylindrical workpiece and the cylindrical supporting device.

In FIGS. 1 and 2, there is illustrated one preferred embodiment of apparatus 2 for stripping a cylindrical workpiece 4, such as a can body, from a cylindrical supporting device 6, such as a punch of a conventional can body making machine. The apparatus 2 has housing means 8 comprising an annular member having a body portion 10 having axially opposite facing planar surfaces 12 and 14. An integral flange portion 16 extends radially outwardly from the body portion 10 and has a plurality of openings 18 which are circumferentially equally spaced apart to provide passageways for threaded bolts (not shown) to mount the housing means 8 on a can body making apparatus so that the housing means 8 are circumjacent the cylindrical workpiece 4 and the cylindrical supporting device 6.

A plurality of resilient fingers 20 are provided and preferably are equally sized and circumferentially equally spaced apart so as to form a generally circular opening 22. Each resilient finger 20 has a flat body portion 24 and an integral flange 26 extending outwardly therefrom and forming an obtuse angle 28 therewith. The flat body portion 24 has oppositely facing parallel surfaces 30 having oppositely facing parallel side edges 32. The flange 26 has oppositely facing surfaces 34 and 36 with the surface 34 facing the cylindrical workpiece 4 and the cylindrical supporting device 6 as they move through the housing means 8 and the surface 36 forms the obtuse angle 28 with the surface 30. The portion of the surface 34 that contacts the cylindrical supporting device 6 is an arcuate surface which is the arc of a circle having a radius which is substantially equal to the radius of the outer surface 38 of the cylindrical workpiece 4. Each body portion 24 has an opening 40 formed therein for purposes described below.

Mounting means are provided for mounting the resilient fingers 20 on the housing means 8 and include an annular member 46 having oppositely facing, parallel planar surfaces 48 and 50 and a radially outer portion 52 having a plurality of circumferentially, equally spaced apart openings 54 formed therein. A plurality of radially extending, circumferentially equally spaced apart recesses 56 are formed in the surface 48 of the annular member 46, and each body portion 24 is seated in one of the recesses 56 so that its surface 30 does not project out of a recess 56. A pin 58 is mounted in the openings 40 and 54 and cooperates with the mounting of the body portion 24 in the recess 56 in preventing relative movement between the annular member 46 and the body portions 24.

The mounting means also includes apparatus for permitting radial movement of the annular member 46 to an adjusted radial location in response to radially applied forces and to hold it at such adjusted location until other radially directed forces are applied thereto. A retainer ring 66 has a plurality of circumferentially equally spaced apart openings 68 which are adapted to be aligned with a plurality of circumferentially equally spaced apart threaded openings 70 in the housing means 8 so that the retainer ring 66 may be secured to the housing means by headed threaded bolts 72. The retainer ring 66 has a radially inwardly extending flange 74 having a surface 76 facing the surface 50 and spaced therefrom to form an annular space therebetween with the retainer ring 66 having an inner cylindrical wall 78 having a diameter greater than the diameter of the outer cylindrical wall 80 of the annular member 46 to provide a space 82 for permitting limited radial movement of the annular member 46 in response to radially directed forces applied thereto. Resilient means are provided to apply a frictional force on the annular member 46 to hold it at an adjusted radial location and comprise a plurality of circumferentially equally spaced apart recesses 84 in the surface 50 and a spring 86 seated in each recess 84 to apply a resilient force on said annular member 46 to force the surface 30 against the surface 76 to generate the frictional force.

The generally circular opening 22 formed by the arcuate surfaces 34 of the flanges 26 has a diameter smaller than the diameter of the outer surface 88 of the cylindrical supporting device 6 and, therefore, also smaller than the outer surface 38 of the cylindrical workpiece 4. During the forward stroke of the cylindrical workpiece 4 and cylindrical supporting surface 6, the cylindrical workpiece 4 moves the resilient flanges 26 radially outwardly and after the cylindrical workpiece 4 has moved through the circular opening, the resilient flanges 26 resile to move into resilient engagement with the outer surface 88. During the return stroke of the cylindrical workpiece 4 and the cylindrical supporting device 6, the resilient flanges 26 remain in contact with the outer surface 88 so that they contact the edge 90 of the cylindrical workpiece 4 so that the continued movement of the cylindrical supporting device 6 disengages the cylindrical workpiece 4 from cylindrical supporting device 6.

If the longitudinal axis of either the cylindrical workpiece 4 or the cylindrical supporting device 6 is not aligned with the longitudinal axis of the stripping apparatus, the cylindrical workpiece 4 or the cylindrical supporting device 6 will exert radially directed forces on at least some of the resilient flanges 26 to move the annular member 46 to an adjusted radial location. The annular member 46 will remain at the adjusted radial location until other radially directed forces are applied thereto.

In one manufacturing process for stripping cylindrical workpieces 4 from cylindrical supporting devices 6, the outer surface of each cylindrical workpiece 4 has a diameter of about 2.489 inches and a wall thickness of about 0.0045 inch. The outer surface of the cylindrical supporting device 6 has a diameter of about 2.480 inches. Each resilient finger 20 is formed from a tempered spring steel material and has a thickness of about 0.025 inch. The obtuse angle 28 is about 105 degrees. The diameter of the circular opening 22 is about 2.472 inches.

In FIGS. 3 and 4, there is illustrated another preferred embodiment of apparatus 102 for stripping a cylindrical workpiece 104, such as a can body, from a cylindrical supporting device 106, such as a punch of a conventional can body making machine. The apparatus 102 has housing means 108 having suitable means (not shown) for mounting the housing means 108 on a can body making apparatus so that the housing means 108 are circumjacent the cylindrical workpiece 104 and the cylindrical supporting device 106.

An annular molded plastic member 120 has a radially outer portion having a generally cylindrical outer surface 122 and a radially inner portion comprising two axially spaced apart portions 124 and 126 with the portion 124 having an arcuate surface 128 and the portion 126 having an arcuate inner surface 130. The radially outer portion has a plurality of axially extending, circumferentially equally spaced apart openings 132 and a plurality of radially extending slots 134 formed therein, which slots 134 extend from the inner surfaces 128 and 130 to the opening 132 so as to form a plurality of circumferentially spaced apart resilient fingers 136 which, in the preferred embodiment, are of equal size and are equally spaced apart. The slots 134 divide the inner surface 128 into a plurality of arcuate surfaces each of which is an arc of a circle having a radius smaller than the radius of the outer surface 146 of the cylindrical supporting device 106 so as to have an interference fit therewith and divide the inner surface 128 into a plurality of circumferentially equally spaced apart surfaces having an axially rounded contour. Each of the resilient fingers 136 has a radially extending recess 138 formed therein, which recess extends from the inner surface 128 to the outer surface 122. A flat, metallic strip 140 is located in each recess 138 and is secured thereto by bolts 142 threaded into the plastic member 120. Each metallic strip 140 has an arcuate inner surface 144 that is an arc of a circle having a radius the same as the arcuate surfaces 124 so as to have an interference fit with the outer surface 146.

Holding means are provided on which the plastic member 120 is mounted and comprise an annular base member 150 having an integral flange portion 152 projecting radially outwardly therefrom. An annular portion 154 projects from the base member 150 in an axial direction and has a cylindrical inner surface 156 having a diameter greater than the diameter of the outer surface 158 of the cylindrical workpiece 104. The annular portion 154 has a radially inwardly extending recess 160 formed therein and, as illustrated in FIG. 4, is adapted to receive the portion 126 of the plastic member 120. In assembly, portions of the portions 126 are placed in a portion of the recess 160 and the annular plastic member 120 is then snapped into assembled position with the portions 126 seated in the recess 160. The annular portion 154 has a surface 162 in contact with surfaces 164 on the resilient fingers 136 to limit axial movement of the resilient fingers 136 during the return stroke of the cylindrical supporting device 106. Although, as stated above, there is an interference fit between the cylindrical supporting device 106 and the resilient fingers 136, the plastic member 120 has sufficient flexibility so that the resilient fingers 136 do not mar or damage the outer surface of the cylindrical supporting device 106 during the return stroke.

Additional mounting means are provided for mounting the annular base member 150 on the housing means 108 and comprise an annular recess 170 formed in the planar surface 172 of the housing means 108 and having an axially extending inner surface 174. The annular base member 150 is positioned in the annular recess 170 so that the planar surface 176 of the flange portion 152 is in contact with the planar surface 172. The flange portion 152 has a plurality of circumferentially equally spaced apart openings 178 formed therein. A retainer ring 180 is mounted on the flange portion 152 and has a plurality of circumferentially equally spaced apart openings 182 with each opening 182 aligned with one of the openings 178. The housing means 108 has a plurality of circumferentially equally spaced apart threaded openings 184 so that a headed threaded bolt 186 passes through the openings 178 and 182 and is threaded into a threaded opening 184 to secure the annular base member on the housing means 108. The annular base member 150 has an axially extending, cylindrical surface 188 facing the surface 174 and having a diameter less than the surface 174 to permit limited movement of the annular base member 150 in radial directions in response to radially directed forces applied thereto by the cylindrical workpiece 104 or the cylindrical supporting device 106. The opening 178 as a diameter greater than the diameter of the portion 190 of the bolt 186 to provide for the limited radial movement. A resilient ring 192 is located between the head 194 of the headed threaded bolt 186 and the surface 196 of the retainer ring 180 so as to apply a resilient force on the flange portion 152 to provide a frictional force to hold the annular base member 150 in an adjusted radial location until another radially directed force is applied thereto.

In one manufacturing process for stripping cylindrical workpieces 104 from a cylindrical supporting device 106, the outer surface of each cylindrical workpiece 104 has a diameter of about 2,489 inches and a wall thickness of about 0.0045 inch. The outer surface of the cylindrical supporting device 106 has a diameter of about 2.480 inches. The plastic member 120 is molded from a material, such as polyethylene. Each metallic strip 140 is formed from a tempered spring steel material, such as stainless steel, and has a thickness of about 0.03 inch. Each of the arcuate surfaces 124 and 144 is an arc of a circle having a diameter of about 2.462 inches.

Figure 5:
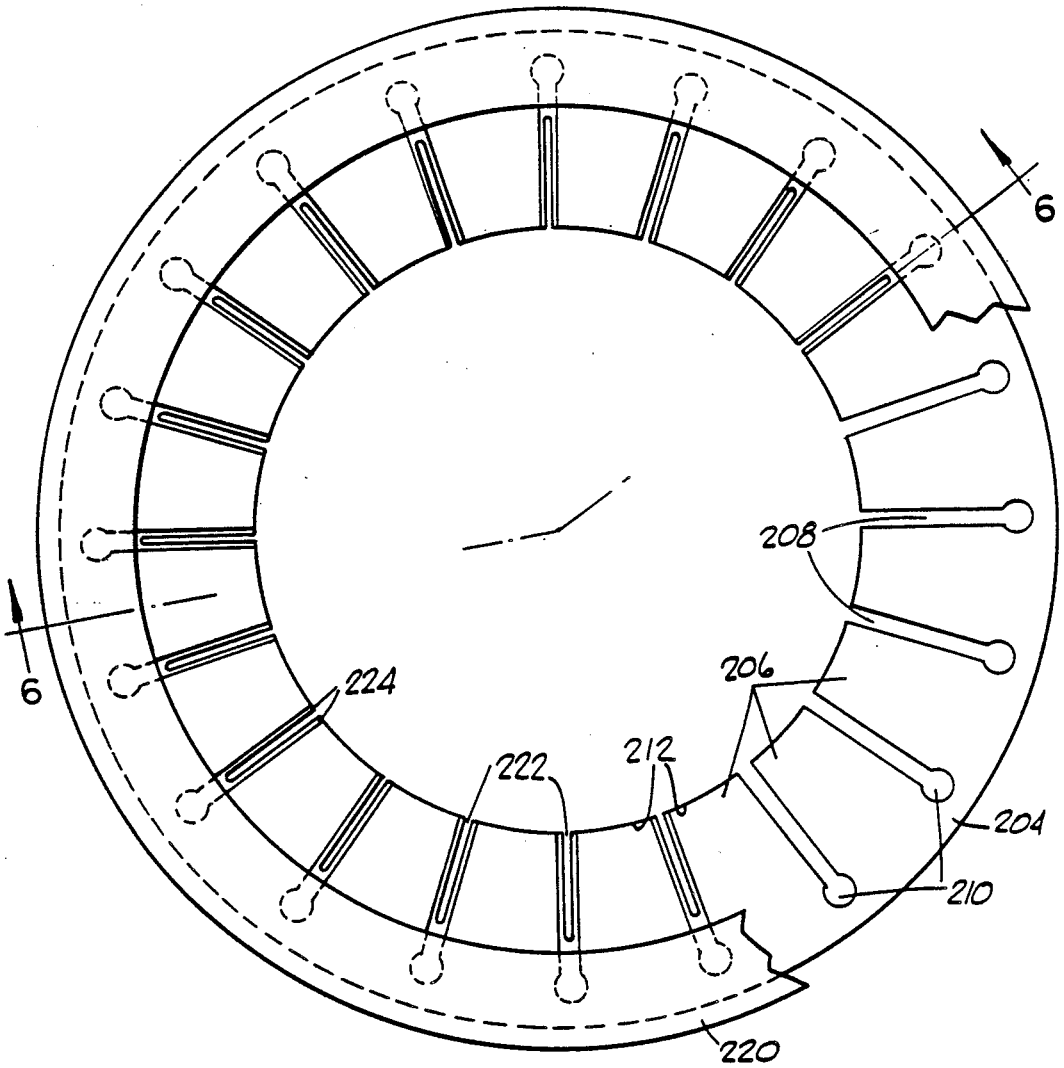
FIG. 5 is a plan view of another embodiment of the stripper apparatus of this invention.
Figure 6:
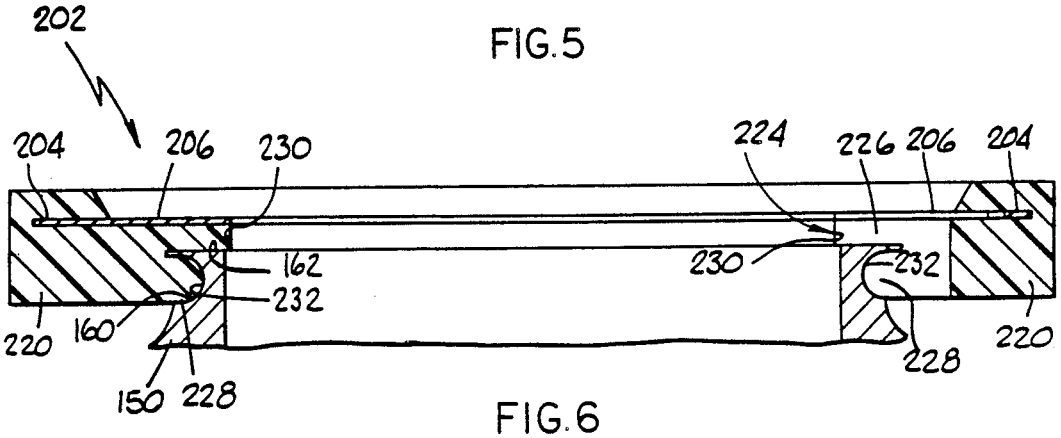
FIG. 6 is a cross-sectional view taken on the line 6—6 of FIG. 5 with parts added.

In FIGS. 5 and 6, there is illustrated another preferred embodiment of apparatus 202 which functions in the same manner as the apparatus 102 of FIGS. 3 and 4 to strip a cylindrical workpiece 104 from a cylindrical supporting device 106. An annular member 204 formed from a resilient metallic material, such as stainless steel, has a plurality of radially inwardly extending integral resilient fingers 206. The resilient fingers 206 are formed by a plurality of radial slots 208 terminating in axially extending openings 210. The resilient fingers 206 are of equal size and are circumferentially equally spaced apart. Each resilient finger 206 has an arcuate inner surface 212 which is an arc of a circle having a radius which is smaller than the radius of the outer surface 146 of the cylindrical supporting device 106 of FIGS. 3 and 4.

An annular plastic member 220 is molded around the annular member 204 so that the annular member 204 and portions of the resilient fingers 206 are embedded therein. A plurality of radially extending slots 222 are formed in the annular plastic member 220, so as to form a plurality of resilient fingers 224 which are circumferentially equally spaced apart. Each resilient finger 224 has a radially inner portion comprising two axially spaced apart portions 226 and 228. Each portion 226 has an arcuate inner surface 230 which is an arc of a circle having the same radius as that of the arcuate surfaces 212. Each portion 228 has an inner surface 232 that is rounded in an axial direction. Each resilient finger 224 has an arcuate extent greater than the arcuate extent of each resilient finger 206 and are in contacting relationship with each other. The embedding of the annular member 204 and the portions of the resilient fingers 206 in the annular plastic member 220 holds the resilient fingers 206 and 224 in contacting relationship so that they move together.

The annular plastic member 220 is mounted on housing means, similar to the housing means 108, by mounting means similar to those illustrated in FIGS. 3 and 4 by snapping the portions 232 into an annular recess 160. The apparatus 202 has dimensions corresponding to those in FIGS. 3 and 4 and functions in the same manner as the apparatus 102.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for stripping a cylindrical workpiece from a cylindrical supporting device on which the cylindrical workpiece is supported so as to have a leading end surface during the return stroke of the cylindrical supporting device comprising:

housing means for supporting the apparatus circumjacent the cylindrical workpiece and the cylindrical supporting device;

a plurality of circumferentially spaced apart resilient fingers, each of which has a flat body portion having oppositely facing parallel surfaces having oppositely facing parallel side edges, a length greater than its width and a thickness substantially smaller than said width and an integral flange portion extending outwardly therefrom and forming an obtuse angle therewith;

metallic mounting means for mounting said resilient fingers on said housing means to form a generally circular opening;

each of said resilient fingers having an inner surface portion;

said generally circular opening having a diameter which is smaller than the diameter of the outer surface of said cylindrical supporting device so that on the return stroke of said cylindrical supporting device said inner surface portions are in contact with said outer surface of said cylindrical supporting device so that said resilient fingers contact said leading end surface of said cylindrical workpiece to disengage said cylindrical workpiece from said cylindrical supporting device;

said mounting means comprising:

an annular member;

a plurality of radially extending, circumferentially spaced apart recesses in said annular member;

each of said body portions being located in one of said recesses;

said annular member having a radially outer portion having a plurality of circumferentially spaced apart openings formed therein;

a retainer ring mounted on said housing means and forming an annular space therebetween with said annular space having a radially outer peripheral wall portion;

said radially outer portion being located in said annular spaced;

said body portion having at least one opening formed therein; and connecting means extending through said opening in said body portion and into an opening in said annular member for connecting said body portion to said annular member so that at least a portion of said body portion is located in said annular space and so that there is no relative movement between said annular member and said body portion.

2. Apparatus as in claim 1 wherein:

said integral flange portion having oppositely facing surfaces;

one of said surfaces comprising said inner surface portion; and the other of said surfaces forming said obtuse angle with said body portion.

3. Apparatus as in claim 1 wherein said connecting means comprises:

a pin having portions thereof located in said opening in said annular member and in said opening in said body portion.

4. Apparatus as in claim 3 and further comprising:

said radially outer portion having an outer peripheral surface having a diameter less than the diameter of said peripheral wall to provide for limited radial movement of said annular member in response to any radially directed force applied to said annular member by said cylindrical workpiece or said cylindrical supporting device; and resilient means urging said annular member against said retainer ring to hold said annular member at an adjusted radial location until another radially directed force is applied thereto.

5. Apparatus as in claim 1 wherein said resilient fingers comprise:

an annular member formed from a resilient metallic material; surface is an arc of a circle having a radius which is slightly smaller than the radius of the outer surface of said cylindrical supporting device so as to have an interference fit therewith.

6. Apparatus as in claim 5 and further comprising:

each of said integral resilient fingers having an arcuate inner surface and each of said plastic resilient fingers having an arcuate inner surface and wherein each of said arcuate inner surfaces is an arc of a circle having a radius smaller than the radius of the outer surface of said cylindrical supporting device so that said metallic resilient fingers and said plastic resilient fingers have an interference fit with said outer surface of said cylindrical supporting device.

7. Apparatus as in claim 6 wherein said mounting means comprises:

an annular base member;

holding means for holding said plastic member on said annular base member to permit movement of said resilient fingers in one axial direction and to limit movement of said resilient fingers in the opposite axial direction; and additional mounting means for mounting said annular base member on said housing means.

8. Apparatus as in claim 7 wherein said holding means comprises:

an annular portion projecting from said annular base member and extending in an axial direction;

said annular portion having an outer surface having a radially inwardly extending recess formed therein;

each of said resilient fingers having a radially inner portion comprising two axially spaced apart portions; and one of said portions having said inner arcuate surfaces and the other of said portions being located in said recess.

9. Apparatus as in claim 8 wherein:

said additional mounting means mounting said annular base member on said housing means for limited movement in radial directions; and resilient means for applying a frictional force on said annular base member to hold said annular member at an adjusted radial location until another radially directed force is applied thereto.

10. Apparatus for stripping a cylindrical workpiece from a cylindrical supporting device on which the cylindrical workpiece is supported so as to have a leading end surface during the return stroke of the cylindrical supporting device comprising:

housing means for supporting the apparatus circumjacent the cylindrical workpiece and the cylindrical supporting device;

a plurality of circumferentially spaced apart resilient fingers;

said resilient fingers comprising an annular molded plastic member having inner and outer surfaces;

a radially outer portion of said plastic member having a plurality of axially extending, circumferentially spaced apart openings formed therein;

said plastic member having a plurality of radially extending slots formed therein and extending from said inner surface to said axially extending openings to form said plurality of resilient fingers;

mounting means for mounting said resilient fingers on said housing means to form a generally circular opening;

each of said resilient fingers having an inner surface portion;

said generally circular opening having a diameter which is smaller than the diameter of the outer surface of said cylindrical supporting device so that on the return stroke of said cylindrical supporting device said inner surface portions are in contact with said outer surface of said cylindrical supporting device so that said resilient fingers contact said leading end surface of said cylindrical workpiece to disengage said cylindrical workpiece from said cylindrical supporting device;

each of said resilient fingers having a radially extending recess formed therein, which recess extends from the inner surface through said radially outer portion; and a flat, metallic resilient strip mounted in each recess.

11. Apparatus as in claim 10 wherein:

said resilient fingers and said resilient strip having an arcuate inner surface which arcuate inner surface is an arc of a circle having a radius which is slightly smaller than the radius of the outer surface of said cylindrical supporting device so as to have an interference fit therewith.

12. Apparatus as in claim 11 wherein said mounting means comprises:

an annular base member;

holding means for holding said plastic member on said annular base member to permit movement of said resilient fingers in one axial direction and to limit movement of said resilient fingers in the opposite axial direction; and additional mounting means for mounting said annular base member on said housing means.

13. Apparatus as in claim 12 wherein:

said additional mounting means mounting said annular base member on said housing means for limited movement in radial directions; and resilient means for applying a frictional force on said annular base member to hold said annular base member at an adjusted radial location until another radially directed force is applied thereto.

14. Apparatus as in claim 13 wherein said resilient means comprises:

said annular base member having a plurality of circumferentially spaced apart openings formed therein;

a retainer ring having a plurality of circumferentially spaced apart openings formed therein;

a plurality of circumferentially spaced apart threaded openings in said housing means so that a headed threaded bolt may be passes through said openings in said annular base member and said retainer ring and threaded into said threaded openings;

each of said openings in said annular base member having a diameter greater than the diameter of said threaded bolt to provide an annular space for said radial movement; and a resilient gasket between said headed threaded bolt and said retainer ring to apply said frictional force on said support member.

15. Apparatus as in claim 12 wherein said holding means comprises:

an annular portion projecting from said annular base member and extending in an axial direction;

said annular portion having an outer surface having a radially inwardly extending recess formed therein;

each of said resilient fingers having a radially inner portion comprising two axially spaced apart portions; and one of said portions having said inner arcuate surfaces and the other of said portions being located in said recess.

* * * * *